US005418856A

United States Patent [19]

Okamoto

[11] Patent Number: 5,418,856

[45] Date of Patent: May 23, 1995

[54] STEREO SIGNAL GENERATOR

[75] Inventor: Seizi Okamoto, Shizuoka, Japan

[73] Assignee: Kabushiki Kaisha Kawai Gakki Seisakusho, Japan

[21] Appl. No.: 154,181

[22] Filed: Nov. 18, 1993

[30] Foreign Application Priority Data

Dec. 22, 1992 [JP] Japan ..... 4-356446

[51] Int. Cl.[6] ..... H04S 5/00

[52] U.S. Cl. ..... 381/17

[58] Field of Search ..... 381/1, 17

[56] References Cited

U.S. PATENT DOCUMENTS

| | | | |
|---|---|---|---|
| 4,239,939 | 12/1980 | Griffis | 381/17 |
| 4,817,149 | 3/1989 | Myers | 381/1 |
| 5,027,689 | 7/1991 | Fujimori | 84/622 |
| 5,052,685 | 10/1991 | Lowe et al. | 381/17 |
| 5,056,149 | 10/1991 | Broadie | 381/17 |
| 5,173,944 | 12/1992 | Begault | 381/17 |

FOREIGN PATENT DOCUMENTS

| | | | |
|---|---|---|---|
| 4177999 | 6/1992 | Japan | 381/17 |
| 942459 | 11/1963 | United Kingdom | 381/17 |

*Primary Examiner*—Forester W. Isen

*Attorney, Agent, or Firm*—Westman, Champlin & Kelly

[57] ABSTRACT

A stereo signal generator for generating stereo signals of a plurality of channels from a single channel input sound signal, which comprises input means for inputting positional information of a sound source, and modification means for dividing the input sound signal into at least two, and for modifying the frequency characteristics (and loudness level as needed) of the respective divided signals based on the positional information of the sound source. The stereo signal generator achieve more natural localization of a sound source.

8 Claims, 3 Drawing Sheets

STEREO SIGNAL GENERATOR

BACKGROUND OF THE INVENTION

1. Field of the Invention

The present invention is related to a stereo signal generator, and particularly to a stereo signal generator which can add a stereophonic sound field effect to a monaural sound signal.

2. Description of the Prior Art

Conventionally, in systems such as electronic musical instruments, loudspeaker systems and audio systems, in which musical tones or the like are generated from the left and right speakers, a technique of varying the ratio of sound volume levels of musical tones generated from the left and right speakers has been used as the method for controlling the localization (pan-pot, pan effect) of a sound source.

FIG. 3 is a block diagram showing the main portions of the conventional localization control circuit. A monaural sound input signal I is supplied to two multipliers 30 and 31, and control signals CR and CL are respectively supplied to each multiplier. These control signals CR, CL are adjusted so that one increases as the other decreases. Multipliers 30 and 31 multiply the input signal I by the respective control signals CR, CL and provides a right output OR and a left output OL, respectively. In the conventional system, the localization of a sound source is controlled by appropriately selecting these control signals.

The human ears are positioned at the left and right sides of the head, and for Instance, a sound reaching from the right-hand side directly reaches the right ear, but it reaches the left ear while going around the head. As the general nature of sound, tile level of a sound going around to tile back of an obstacle lowers by diffraction as the frequency increases.

Accordingly, for a sound coming from the right-hand side, the sounds listened by tile right and left ears are different not only in tile volume level but also in the frequency characteristics. On the other hand, in the system in which musical tones or the like are provided from two, that is, left and right speakers, tile sounds generated from the left and right speakers directly reach the left and right ears, respectively. This is more remarkable in headphones or carphones.

In these systems, since the localization is controlled only by changing the volume balance, the frequency characteristics of the sounds generated from the left and right speakers are different from those of the sounds reaching the ears from a natural sound source, and thus there has been a problem that the localization is unnatural and presence or ambience is poor.

SUMMARY OF THE INVENTION

It is an object of the present invention to provide a stereo signal generator in which more natural localization can be achieved.

The present invention is a stereo signal generator for generating multichannel stereo signals from one input sound signal, characterized by comprising input means for inputting positional information of a sound source, and modification means for distributing the input sound signal into a plurality of sound signals, and modifying the 10 frequency characteristics of the respective distributed sound signals based on the positional information of the sound source that was input from the input means. This allows musical tones and/or sounds similar to those for an actual sound source to reach the left and right ears, providing natural localization.

DETAILED DESCRIPTION OF THE PREFERRED EMBODIMENT

Figure 1:
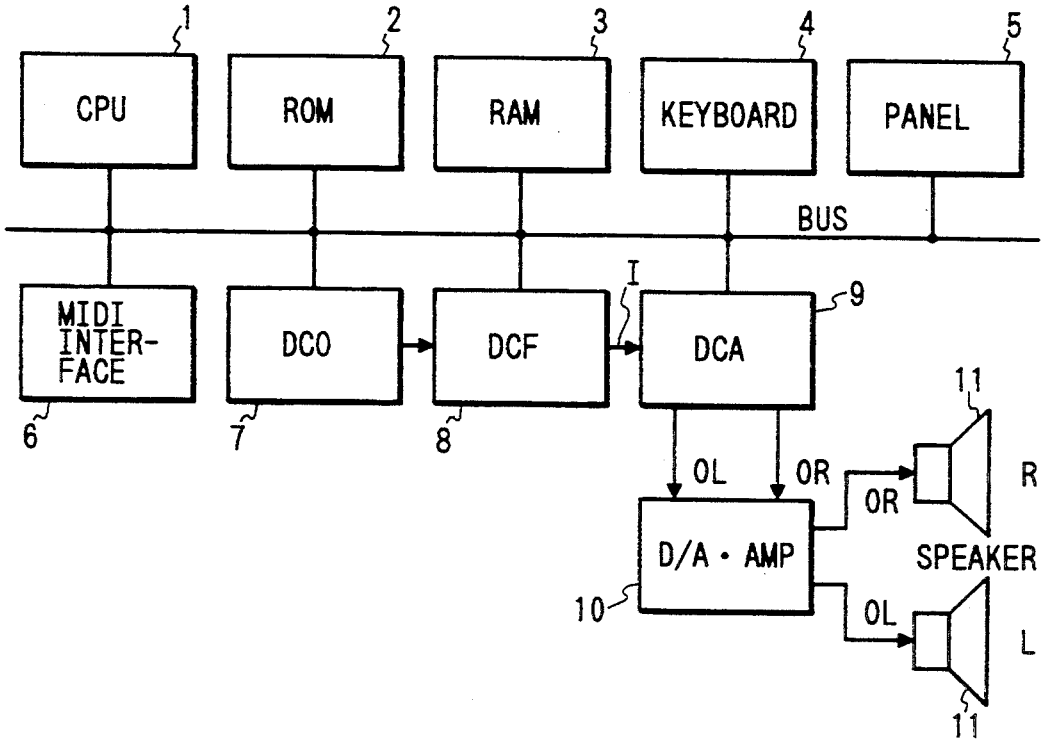
FIG. 1 is a block diagram representing the hardware configuration of an electronic musical instrument according to the present invention.

By using an electronic musical instrument as an example, an embodiment of the present invention is described in detail with reference to the drawings. FIG. 1 is a block diagram representing the hardware configuration of an electronic musical instrument incorporating the present invention. CPU 1 performs the control of the whole electronic musical instrument such as key assigning and tone generating control. In ROM 2, programs and data necessary for the control are stored. In RAM 3, various control data in the instrument and/or MIDI (Musical Instrument Digital Interface) data are stored. Keyboard 4 consists of a plurality of keys each having a switch or switches, and a keyboard interface circuit (not shown) which scans tile key switches under the control of CPU 1. Panel 5 consists of parlous switches including those for inputting positional information on pan effect, a display device such as LCD (Liquid Crystal Display) and/or LED, and a panel interface circuit (not shown) which reads in the states of the various switches and outputs various information to the display device under the control of CPU 1. MIDI interface 6 is a circuit for input/output of MIDI signals with an external MIDI compatible equipment.

DCO (digital controlled oscillator) 7 produces digital musical tone signals by reading out waveform signals from ROM 2 or the internal waveform memory (not shown) at an address interval corresponding to a specified frequency under the control of CPU 1. DC0 7 is not limited to such one, but any one may be available as long as it can generate digital musical signals having a desired frequency and waveform. DCF (digital controlled filter) 8 filters the output signals from DCO 7 with frequency characteristics specified from CPU 1. The tone color of musical tone signals can be changed by controlling DCF 8.

DCA (digital controlled amplifier) 9 is a circuit for controlling the envelope, loudness, localization and the like of musical tone signals, as described in detail later. D/A·AMP (D/A converter and amplifier) 10 consists of a D/A converter and amplifiers for two, or left and right channels, and supplies musical tone signals to right and left speakers 11. DC0 7, DCF 8 and DCA 9 are generally capable of performing independent tone generating processes of a plurality of channels by time division multiprocessing, and the tone signals of the respective channels which are output from DCA 9 are added independently for respective channels and output to D/A·AMP 10 as the right tone signal OR and the left tone signal OL. In addition, an FDD (floppy-disk drive), memory card interface circuit and the like may be provided as needed.

Figure 2:
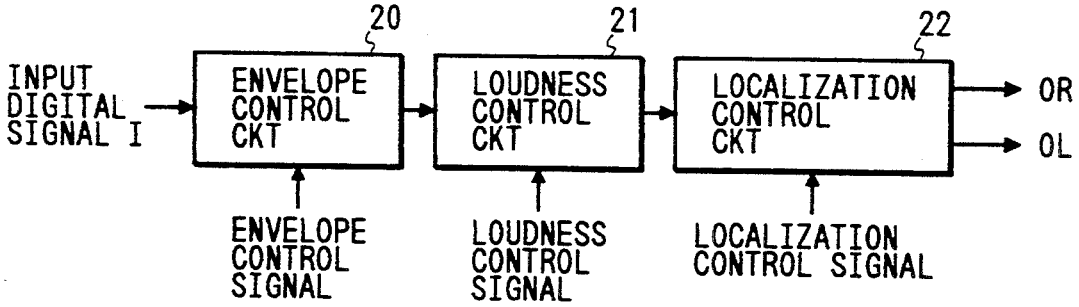
FIG. 2 is a block diagram representing the internal configuration of the DCA shown in FIG. 1.
Figure 3:
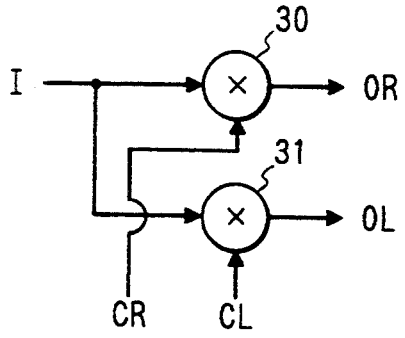
FIG. 3 PRIOR ART
FIG. 3 is a block diagram showing the main portions of the conventional localization control circuit.

FIG. 2 is a block diagram representing the internal configuration of the DCA 9 in FIG. 1. Envelope control circuit 20 controls at least one of the envelope phase of attack, decay, sustain and release and the like of an input digital signal I under the control of CPU 1. In fact, said control is performed, for instance, by reading out a waveform from the memory in which envelope waveforms are stored, or generating an envelope waveform by a predetermined calculation and multiplying envelope signal by the input signal I.

Loudness control circuit 21 multiplies the output signal of the envelope control circuit 20 by a value specified by the volume control or the like, also under the control of CPU 1. The loudness control may be made concurrently with the envelope control, alternatively. Localization control circuit 22 is to divide a single channel output signal from the loudness control circuit 21 into two, that is, left and right channel signals, also under the control of CPU 1, as described in detail later. Although shown for only one channel in FIG. 2, the envelope control circuit 20, loudness control circuit 21 and localization control circuit 22 can all serve a plurality of channels at the same time by time division multiple processing. In electronic musical instruments, since the positional information of sound sources can be set for each tone color or MIDI channel in general, localization control circuit 22 independently modifies in time division multiple processing mode the frequency characteristics of each divided signal for each channel, based on the positional information of the sound source corresponding to the tone color in the tone generating information assigned to each channel.

Figure 4:
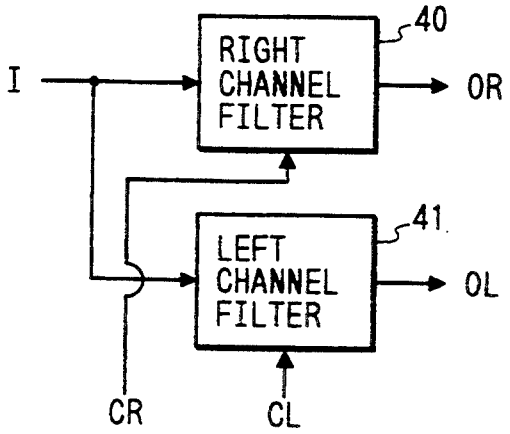
FIG. 4 is a block diagram representing an example of the internal configuration of the localization control circuit according to the present invention.

FIG. 4 is a block diagram representing an example of the localization control circuit 22 in FIG. 2. The input signal I is supplied to two digital filters 40 and 41 for right and left channels, respectively. As digital filter, any device may be used as long as it can vary in the frequency characteristics according to the control signal from CPU 1, for instance, a digital signal processor. CPU 1 uses a positional information/filter control signal conversion table stored in ROM 2 to convert the positional information of a sound source to filter control signals CR and CL which are supplied to the respective filters 40 and 41. The outputs of the respective filters 40 and 41 are output as right and left musical tone signals OR and OL.

Figure 5A:
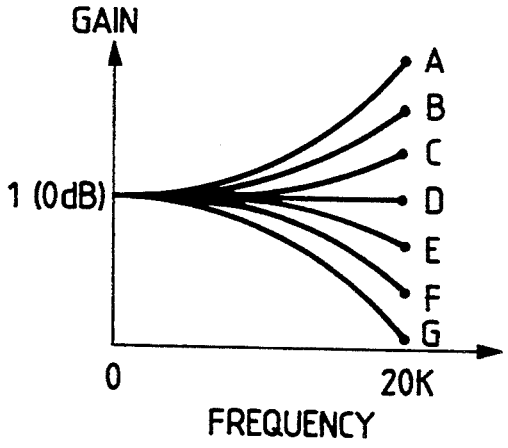
FIG. 5A and 5B represent graphs showing filter characteristics suitable for the present invention.

FIG. 5A is a graph showing the frequency characteristics of filters 40 and 41 in one embodiment of the present invention. If the sound source position is centrally set in the median plane of a listener, filters 40 and 41 are both provided with a flat characteristic D having a gain of 0 dB=1. If it is desired to position the sound source rightward of the median plane, the filter 40 for the right channel is controlled to have a characteristic in which higher frequencies are emphasized (for instance, curve A), and simultaneously the filter 41 for the left channel is controlled to have another characteristic in which higher frequencies are attenuated (for instance, curve G). That is, in response to an input of information of a desired sound source position from the panel or the like, CPU controls tile characteristic of the right filter 40 to change, for example, in a sequence of A→B→C→D→E→F→G, and simultaneously controls the characteristic of the left filter 41 to inversely change in a sequence of G→F→E→D→C→B→A. Such complementary control provides more natural localization.

Figure 5B:
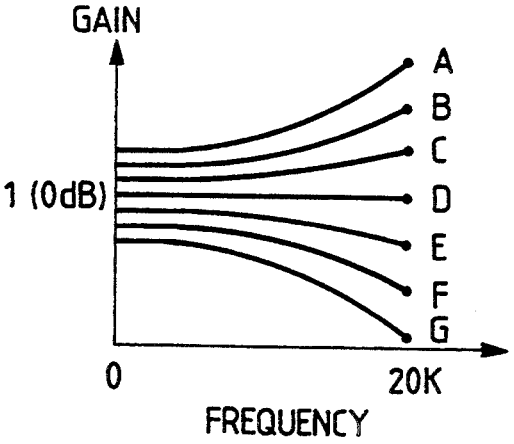

FIG. 5B is a graph showing a variation example of the frequency characteristics of the filters. In the figure, A′, B′ and C′ are emphasized in higher frequencies, and also increased in the level of lower frequencies over the flat one (D′). E′, F′ and G′ are attenuated in higher frequencies, and also rather attenuated in lower frequencies. That is, the overall level is changed along with the modification (emphasis or attenuation) in higher frequencies. Combinations of the frequency characteristics for the two filters are not always symmetrical, for example, a combination of A(A′) and E(E′). B(B′) and G(G′), B(B′) and D(D′) or A(A′) and E′(E) may be available. A frequency characteristic curve which can actually provide natural localization can experimentally be decided. For instance, it is only needed to detect the sounds from the sound sources at various positions by means of dummy head microphones, check the frequency characteristics of the outputs of the microphones, and control the filters to reproduce corresponding frequency characteristics.

Figure 6:
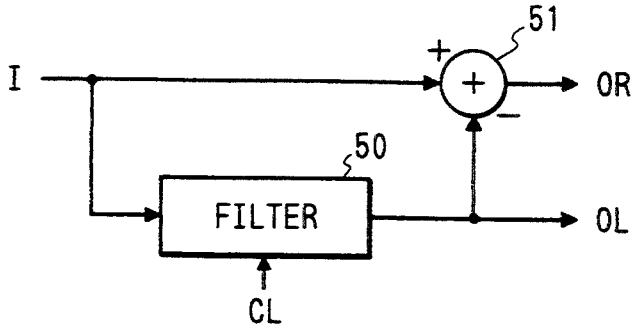
FIG. 6 is a block diagram representing another example of the internal configuration of the localization control circuit.

FIG. 6 is a block diagram representing another example of the localization control circuit 22 of the present invention. Filter 50 is provided only in one channel (in the figure, the left channel), and in the other channel, there is provided adder 51 for subtracting the output OL of the filter 50 from the input signal I.

Figure 7A:
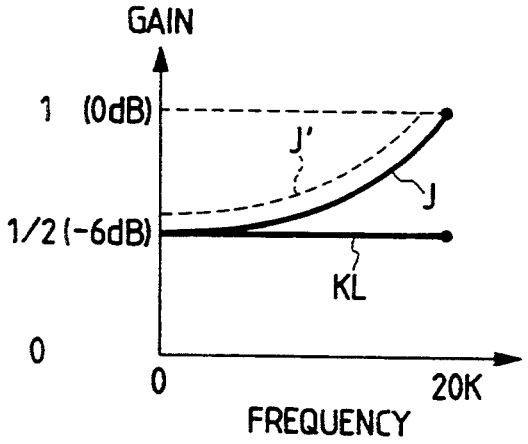
FIGS. 7A, 7B, and 7C represent frequency characteristic diagrams of the filter and the output signals in another embodiment of the present invention.
Figure 7B:
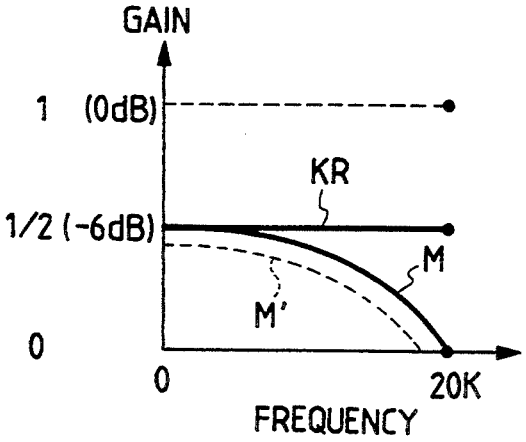

FIG. 7A is a graph showing the frequency characteristics of filter 50. If filter 50 is set to a flat output characteristic like a characteristic KL in which the output level is ½ (−6 dB) of the input level over the whole frequency range, the output 0L of filter 50 is also ½ of the input signal level. On the other hand, the right output OR shown in FIG. 7B is the input signal I minus the output OL, and since the characteristic of the output OR is also a flat characteristic which is ½ of the input signal as shown by a line KR, the sound source is positioned in the median plane of the listener. If the characteristic of filter 50 is changed to be emphasized in higher frequencies as shown by a curve J in FIG. 7A, the output OL naturally shows a characteristic like J which is emphasized In higher frequencies. In addition, since the characteristic of the output OR is obtained by subtracting the output OL of a characteristic like J from the input signal I, it is attenuated in higher frequencies as a curve M in FIG. 7B. Accordingly, the sound source position moves leftward.

Figure 7C:
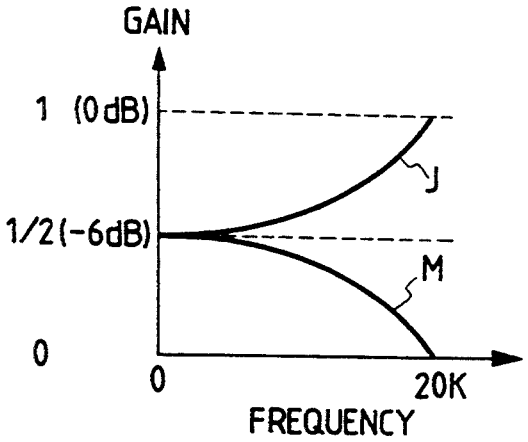

Eventually, if the output of one channel is obtained with filter 50 being set to the characteristic J or M shown in FIG. 7C, then the frequency characteristic of the output of the other channel is obtained by reversing the characteristic J or M with respect to a line the gain of which is ½ (−6 dB) or flat.

Consequently, if the characteristic of filter 50 is appropriately selected according to information of a desired sound source position, the outputs of the left and right channels having the characteristic of FIG. 5A or FIG. 5B of the first embodiment can be provided. In these embodiments, at whatever position the sound source is set, the sum of the L-output and the N-output has the same frequency characteristic as the input signal. A level modification (curves J′ and M′) may be performed in addition to tile characteristic modification for higher frequencies as in the example of FIG. 5B.

Further, the present invention may be varied as follows.

In the circuit of FIG. 4, the frequency characteristics of tile respective left and right channels can independently be controlled by the two filters, and thus 10 the tone color control function of DCF 8 in FIG. 1 can also be accomplished by these filters to obviate DCF 8. In addition, one of the two filters in FIG. 4 may be omitted and the frequency characteristic of the remaining filter may be set to either of the characteristics shown in FIGS. 5A and 5B according to the information of a sound source position.

The input of positional information for pan effect can be performed not only from the panel but also by a MIDI signal. It is also possible that CPU 1 obtains sound source position information from the pan-pot control signal defined in a MIDI signal to produce a filter control signal.

Figure 8:
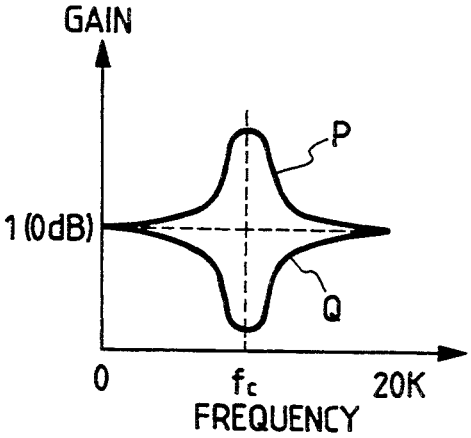

The number of sound channels is not limited to two, but the present invention is also applicable when the input signal is distributed into any number larger than two. Moreover, the respective filters may be set, as shown by P and Q in FIG. 8, to the characteristics of a band-pass filter and a band-eject filter having a specific center frequency fc, and control of the sound volume balance only in the particular frequency band may allow only the localization of the sound in that frequency band to be controlled.

As described above, in accordance with the present invention, by distributing a single channel input sound signal to a plurality of channels, and by modifying the 10 frequency (and loudness level, if necessary) characteristics of the respective distributed signals based on the positional information of a sound source, so that they are different for each channel, musical tones similar to those from a natural sound source can be caused to reach the left and right ears of the listener, and thus there is an advantage that natural localization and increased presence can be obtained.

Although examples applied to electronic musical instruments are disclosed as the embodiments, the present invention is not limited to those, but also can be applied to various audio systems such as stereo systems, karaoke systems and loudspeaker systems, or recording and mixing systems in studios and the like. In addition, if the input sound signal to these systems is analog, the techniques in the above described embodiments can directly applied by converting the input sound signal to a digital signal by means of an A/D converter.

What is claimed is:

1. A stereo signal generator suitable for generating a stereo signal having at least two channels from an input sound signal having a single channel wherein the input sound signal includes a high frequency range and a sound level, the stereo signal generator comprising:

input means for providing a sound source position signal;

distributor means for providing the input sound signal to a first channel and a second channel;

a first filter, operably coupled to the input means and the first channel, the first filter having frequency characteristics set to emphasize the high frequency range based on the sound source position signal; and a second filter, operably coupled to the input means and the second channel, the second filter having frequency characteristics set to attenuate the high frequency range complimentarily to the first filter and based upon the sound source position signal, such that localization of a sound source is created.

2. The stereo signal generator of claim 1 wherein the first and second filters modify the sound level.

3. The stereo signal generator of claim 1 wherein the input sound signal further includes a tone color and wherein the first and second filters are capable of varying the respective frequency characteristics to modify the tone color.

4. The stereo signal generator of claim 1 wherein the input sound signal is a time division musical tone signal from a plurality of musical tone generating channels of electronic musical instruments, wherein the first and second filters independently modify their respective frequency characteristics by time division multiprocessing based on the sound source position signal corresponding to a particular tone color information assigned to each musical tone generating channel.

5. A stereo signal generator suitable for generating a stereo signal having at least two channels from an input sound signal having a single channel wherein the input sound signal includes a high frequency range and a sound level, the stereo signal generator comprising:

input means for providing a sound source position signal;

distributor means for providing the input sound signal to a first channel and a second channel;

a filter, operably connected to the input means and the first channel, having frequency characteristics for modifying the high frequency range based on the sound source position signal and for outputting a first output signal;

a subtractor operably connected to the filter and the second channel for subtracting the first output signal from the input sound signal and for outputting a second output signal such that location of a sound source is created.

6. The stereo signal generator of claim 5 wherein the first filter modifies the sound level.

7. The stereo signal generator of claim 5 wherein the input sound signal is a time division musical tone signal from a plurality of musical tone generator channels of electronic musical instruments, and wherein the filter and subtractor independently modify the frequency characteristics of their respective channels by time division multiprocessing based on the sound source position signal corresponding to a particular tone color information assigned to each musical tone generating channel.

8. A stereo signal generator for generating stereo signals of a plurality of channels from an input sound signal of a single channel so that a localization of a sound source is created, the stereo signal generating comprising:

input means for inputting positional information of a sound source;

means for distributing the input sound signal to a plurality of channels; and modifying means for emphasizing the high frequency characteristics of a distributed signal for at least one channel based on the positional information of the sound source.

* * * * *